US009640192B2

(12) United States Patent
Son et al.

(10) Patent No.: US 9,640,192 B2
(45) Date of Patent: May 2, 2017

(54) ELECTRONIC DEVICE AND METHOD OF CONTROLLING ELECTRONIC DEVICE

(71) Applicant: Samsung Electronics Co., Ltd., Suwon-si, Gyeonggi-do (KR)

(72) Inventors: Beak Kwon Son, Yongin-si (KR); Jun Tai Kim, Seongnam-si (KR); Chul Hwan Lee, Seoul (KR); Jae Goo Choi, Seoul (KR); Nam Il Lee, Suwon-si (KR); Chul Min Choi, Seoul (KR); Gang Youl Kim, Suwon-si (KR); Mi Hyang Kim, Suwon-si (KR); Eui Soon Park, Yongin-si (KR); Ho Chul Hwang, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 138 days.

(21) Appl. No.: 14/626,255

(22) Filed: Feb. 19, 2015

(65) Prior Publication Data

US 2015/0235644 A1 Aug. 20, 2015

(30) Foreign Application Priority Data

Feb. 20, 2014 (KR) ..... 10-2014-0019718

(51) Int. Cl.

| | |
|---|---|
| ***G10L 19/00*** | (2013.01) |
| ***G10L 21/003*** | (2013.01) |
| *G10L 19/24* | (2013.01) |
| *G10L 21/038* | (2013.01) |

(52) U.S. Cl.

CPC ..... *G10L 21/003* (2013.01); *G10L 19/24* (2013.01); *G10L 21/038* (2013.01)

(58) Field of Classification Search

CPC ..... G10L 21/038; G10L 19/008; G10L 19/24; G10L 21/003; H04R 3/14; H04R 2430/03; H04B 1/1036; H04B 1/109

USPC ..... 704/268, 500, 200.1, 220, 230, 501

See application file for complete search history.

(56) References Cited

U.S. PATENT DOCUMENTS

| | | | | |
|---|---|---|---|---|
| 6,349,197 | B1 | 2/2002 | Oestreich | |
| 6,507,820 | B1 | 1/2003 | Deutgen | |
| 6,539,355 | B1 | 3/2003 | Omori et al. | |
| 6,782,367 | B2 | 8/2004 | Vainio et al. | |
| 7,340,379 | B2 | 3/2008 | Kunkel et al. | |
| 7,676,043 | B1 | 3/2010 | Tsutsui et al. | |
| 7,715,573 | B1 | 5/2010 | Yonemoto et al. | |
| 7,813,931 | B2 | 10/2010 | Hetherington et al. | |
| 8,000,968 | B1 * | 8/2011 | Liu | G10L 19/24 370/477 |
| 8,036,394 | B1 | 10/2011 | Yonemoto et al. | |

(Continued)

FOREIGN PATENT DOCUMENTS

| | | |
|---|---|---|
| CA | 2 865 533 A1 | 9/2013 |
| CN | 1427989 A | 7/2003 |

(Continued)

*Primary Examiner* — Charlotte M Baker
(74) *Attorney, Agent, or Firm* — Jefferson IP Law, LLP

(57) ABSTRACT

An electronic device is provided. The electronic device includes a reception unit configured to receive an audio signal, a bandwidth change unit configured to gradually change a bandwidth of the received audio signal from a first bandwidth to a second bandwidth during a preset time, when the received audio signal is changed, and an audio output unit configured to output the received audio signal.

15 Claims, 10 Drawing Sheets

(56) References Cited

U.S. PATENT DOCUMENTS

| | | | |
|---|---|---|---|
| 8,121,847 | B2 | 2/2012 | Klinke et al. |
| 8,311,842 | B2 | 11/2012 | Song et al. |
| 8,396,716 | B2 | 3/2013 | Qi et al. |
| 8,560,304 | B2 | 10/2013 | Choo et al. |
| 8,560,329 | B2 | 10/2013 | Qi et al. |
| 8,712,768 | B2 | 4/2014 | Laaksonen et al. |
| 2001/0044712 | A1 | 11/2001 | Vainio et al. |
| 2004/0064324 | A1 | 4/2004 | Graumann |
| 2004/0138876 | A1 | 7/2004 | Kallio et al. |
| 2005/0267741 | A1 | 12/2005 | Laaksonen et al. |
| 2006/0111150 | A1 | 5/2006 | Klinke et al. |
| 2006/0187032 | A1 | 8/2006 | Kunkel et al. |
| 2006/0247922 | A1 | 11/2006 | Hetherington et al. |
| 2008/0004866 | A1 | 1/2008 | Virolainen et al. |
| 2008/0188965 | A1 | 8/2008 | Bruey |
| 2008/0215344 | A1 | 9/2008 | Song et al. |
| 2008/0270125 | A1 | 10/2008 | Choo et al. |
| 2010/0169086 | A1 | 7/2010 | Qi et al. |
| 2010/0228557 | A1 | 9/2010 | Chen et al. |
| 2013/0117030 | A1 | 5/2013 | Qi et al. |
| 2013/0230057 | A1 | 9/2013 | Hori et al. |
| 2013/0242858 | A1 | 9/2013 | Amine |
| 2015/0006163 | A1 | 1/2015 | Liu et al. |

FOREIGN PATENT DOCUMENTS

| | | | |
|---|---|---|---|
| CN | 101335002 | A | 12/2008 |
| CN | 101425292 | A | 5/2009 |
| CN | 101499278 | A | 8/2009 |
| CN | 101964189 | A | 2/2011 |
| EP | 2 629 293 | A2 | 8/2013 |
| WO | 01/86635 | A1 | 11/2001 |
| WO | 02/058055 | A1 | 7/2002 |

* cited by examiner

ELECTRONIC DEVICE AND METHOD OF CONTROLLING ELECTRONIC DEVICE

CROSS-REFERENCE TO RELATED APPLICATION(S)

This application claims the benefit under 35 U.S.C. §119 (a) of a Korean patent application filed on Feb. 20, 2014 in the Korean Intellectual Property Office and assigned Ser. No. 10-2014-0019718, the entire disclosure of which is hereby incorporated by reference.

TECHNICAL FIELD

The present disclosure relates to an electronic device receiving and outputting an audio signal and a method of controlling the electronic device.

BACKGROUND

With the development of an electronic technology and communication network, various devices and methods enabling communication between users are being developed. Thus, users may perform communication by using various methods such as a wireless phone, internet phone, video communication as well as a corded phone.

In particular, a communication technology using a wireless communication technology enables communication with the opposite side any time irrespective of a time or place. Due to such convenience, mobile communication devices are currently possessed by most people.

A 4th generation (4G) mobile communication technology enabling high-speed data transmission has also been recently developed succeeding $1^{st}$ Generation (1G) mobile communication technology enabling only voice calls, $2^{nd}$ Generation (2G) and $3^{rd}$ Generation (3G) mobile communication technologies. In the case of a voice call, a 3G mobile communication service, such as wideband code division multiple access (WCDMA), compresses a voice signal by using an adaptive multirate-narrowband (AMR-NB) mode but recently, an adaptive multirate-wideband (AMR-WB) compression mode has been developed which is capable of providing a high-quality audio service such as a voice over LTE (VoLTE) service and providing a wider frequency band and high-quality sound as compared to the AMR-NB.

A mobile communication device is being recently manufactured to be capable of use both an AMR-NB mode and AMR-WB mode for a voice call service. Thus, while a voice call is performed by using a 3G mobile communication service, there may be cases where an AMR-NB mode service is switched to an AMR-WB mode service or vice versa for some reasons such as a network situation or handover. When a compression mode varies during the voice call, a user experiences a sudden change in sound quality and thus there may be a limitation in that a commitment to the call decreases.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an electronic device that may prevent a sudden change in sound quality to enable a call to be smoothly performed even if the quality of an audio signal varies according to a change in the compression mode of the audio signal, and method of controlling the electronic device.

Another aspect of the present disclosure is to provide an electronic device that may provide a notification of a change in the audio signal or in sound quality to a user when the quality of the audio signal varies during the call, and a method of controlling the electronic device.

In accordance with an aspect of the present disclosure, an electronic device is provided. The electronic device includes a reception unit configured to receive an audio signal, a bandwidth change unit configured to gradually change a bandwidth of the received audio signal from a first bandwidth to a second bandwidth during a preset time, when the received audio signal is changed, and an audio output unit configured to output the received audio signal output from the bandwidth change unit.

The bandwidth change unit may include a bandwidth expansion unit configured to, when the received audio signal is changed from a wideband signal to a narrowband signal, expand the bandwidth of the received audio signal to the first bandwidth and gradually reduce the bandwidth of the received audio signal to the second bandwidth during the preset time, and a bandwidth reduction unit configured to, when the received audio signal is changed from the narrowband signal to the wideband signal, reduce the bandwidth of the received audio signal to the first bandwidth and gradually increase the bandwidth of the received audio signal to the second bandwidth during the preset time, herein, when the bandwidth reduction unit is operable, the first bandwidth corresponds to the narrowband signal and the second bandwidth corresponds to the wideband signal wherein, when the bandwidth expansion unit is operable, the first bandwidth corresponds to the wideband signal and the second bandwidth corresponds to the narrowband signal, and wherein, when the bandwidth reduction unit is operable, the first bandwidth corresponds to the narrowband signal and the second bandwidth corresponds to the wideband signal.

The bandwidth expansion unit may include a signal generation unit configured to generate a high-band signal by using the received audio signal and gradually reduce a maximum frequency of the high-band signal from a maximum frequency of the wideband signal to a maximum frequency of the narrowband signal and a signal synthesis unit configured to synthesize the received audio signal and the high-band signal.

The bandwidth expansion unit may include a signal generation unit configured to generate a high-band signal by using the received audio signal, a signal synthesis unit configured to synthesize the received audio band and the high-band signal, and a low pass filter configured to filter the synthesized signal by decreasing a cut-off frequency from a maximum frequency of the wideband signal to a maximum frequency of the narrowband signal.

The bandwidth reduction unit may include a low pass filter configured to filter the received audio signal by increasing a cut-off frequency from a maximum frequency of the narrowband signal to a maximum frequency of the wideband signal.

The electronic device may further include a buffer configured to store the received audio signal for the preset time and then output the signal to the bandwidth change unit, wherein the bandwidth change unit may include a bandwidth expansion unit configured to, when the received audio signal is changed from the narrowband signal to the wideband signal, expand the bandwidth of the received audio signal to the first bandwidth and gradually reduce the bandwidth of the received audio signal to the second bandwidth during the preset time and a bandwidth reduction unit configured to, when the received audio signal is changed from the wideband signal to the narrowband signal, reduce the bandwidth of the received audio signal to the first bandwidth and gradually increase the bandwidth of the received audio signal to the second bandwidth during the preset time, wherein, when the bandwidth expansion unit is operable, the first bandwidth corresponds to the wideband signal and the second bandwidth corresponds to the narrowband signal, and wherein, when the bandwidth reduction unit is operable, the first bandwidth corresponds to the narrowband signal and the second bandwidth corresponds to the wideband signal.

The bandwidth expansion unit may include a signal generation unit configured to generate a high-band signal by using the received audio signal input from the buffer and gradually expand a maximum frequency of the high-band signal from a maximum frequency of the narrowband signal to a maximum frequency of the wideband signal and a signal synthesis unit configured to synthesize the received audio signal and the high-band signal.

The bandwidth expansion unit may include a signal generation unit configured to generate a high-band signal by using the received audio signal input from the buffer, a signal synthesis unit configured to synthesize the received audio band and the high-band signal, and a low pass filter configured to filter the synthesized signal by increasing a cut-off frequency from a maximum frequency of the narrowband signal to a maximum frequency of the wideband signal.

The bandwidth reduction unit may include a low pass filter configured to filter the received audio signal input from the buffer by decreasing a cut-off frequency from a maximum frequency of the wideband signal to a maximum frequency of the narrowband signal.

The audio output unit may be configured to output a signal providing a notification that sound quality of the audio signal is changed, when the received audio signal is changed.

The electronic device may further include a display unit configured to display an object that represents the notification.

In accordance with another aspect of the present disclosure, a method of controlling an electronic device is provided. The method includes receiving an audio signal, gradually changing a bandwidth of the received audio signal from a first bandwidth to a second bandwidth during a preset time, when the received audio signal is changed, and outputting the received audio signal.

Changing the bandwidth of the received audio signal may include, when the received audio signal is changed from a wideband signal to a narrowband signal, expanding the bandwidth of the received audio signal to the first bandwidth and gradually reducing the bandwidth of the received audio signal to the second bandwidth during the preset time.

Expanding of the bandwidth may include generating a high-band signal by using the received audio signal and synthesizing the received audio signal and the high-band signal.

Gradually reducing of the bandwidth of the received audio signal to the second bandwidth may include gradually reducing a maximum frequency of the high-band signal from a maximum frequency of the received audio signal to a maximum frequency of the narrowband signal.

Gradually reducing of the bandwidth of the received audio signal to the second bandwidth may include filtering the synthesized signal by decreasing a cut-off frequency of a low pass filter from a maximum frequency of the received audio signal to a maximum frequency of the narrowband signal.

Gradually changing a bandwidth of the received audio signal may include, when the received audio signal is changed from the narrowband signal to the wideband signal, reducing the bandwidth of the received audio signal to the first bandwidth and gradually increasing the bandwidth of the received audio signal to the second bandwidth during the preset time.

Gradually increasing of the bandwidth of the received audio signal to the second bandwidth may include filtering the received audio signal by increasing a cut-off frequency of a low pass filter from a maximum frequency of the narrowband signal to a maximum frequency of the wideband signal.

The method may further include outputting a signal providing a notification that sound quality of the audio signal is changed, when the received audio signal is changed.

The method may further include displaying an object that represents the notification.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
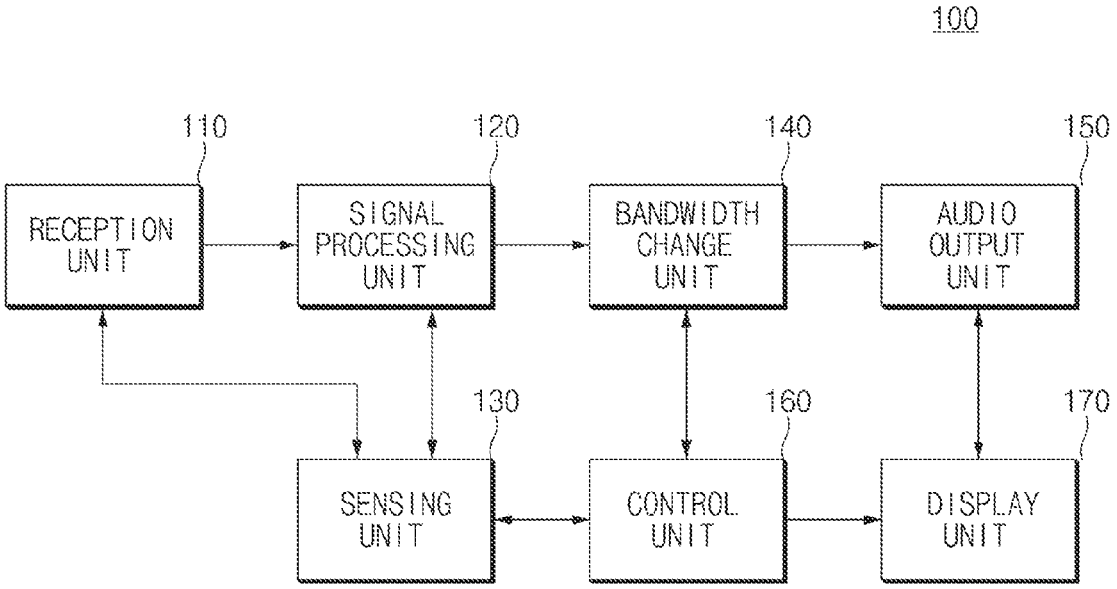
FIG. 1 is a block diagram of an electronic device according to an embodiment of the present disclosure.

FIG. 1 is a block diagram of an electronic device according to an embodiment of the present disclosure.

Referring to FIG. 1, an electronic device 100 according to an embodiment of the present disclosure includes a reception unit 110, a signal processing unit 120, a sensing unit 130, a bandwidth change unit 140, an audio output unit 150, a control unit 160, and a display unit 170. The electronic device 100 may be implemented in various types of electronic devices that may receive an audio signal and output a received audio signal, such as a portable phone, a smart television (TV), a desktop personal computer (PC), a tablet PC, a notebook computer and a PC.

The reception unit 110 receives an audio signal. For example, the reception unit 110 may receive an audio signal including the opposite side's voice from a transmission-side electronic device when a user performs a voice call by using the electronic device 100. Alternatively, when a user reproduces an audio signal through an audio streaming service by using the electronic device 100, the reception unit may receive an audio signal from a web server.

The signal processing unit 120 processes the audio signal received by the reception unit 110. In particular, the signal processing unit 120 may perform signal processing on an audio signal by using a decoder, a mixer, a filter, or an equalizer, for example. Although FIG. 1 shows that the signal processing unit 120 is in front of the bandwidth change unit 140, some components of the signal processing unit 120 may also be located after the bandwidth change unit 140.

The sensing unit 130 may determine whether the audio signal received by the reception unit 110 changes. In particular, the sensing unit 130 may determine whether the bandwidth of a received audio signal changes. The audio signal received by the reception unit 110 may be changed for various reasons such as a change in network environment, a handover, and so forth. The sensing unit 130 may determine the codec type, the sampling rate and the bandwidth of the audio signal received by the reception unit 110 or the audio signal signal-processed by the signal processing unit 120 to determine whether the received audio signal has been changed.

For example, while a voice call is performed by using the electronic device, a handover occurs and thus the codec of the audio signal may change from adaptive multirate wideband (AMR-WB) to adaptive multirate narrowband (AMR-NB). A 3G mobile communication system may compress an audio signal by using two modes, the AMR-NB and the AMR-WB modes. An AMR-NB compression mode may sample an audio signal having a frequency of about 4 kHz or lower (e.g., about 200 Hz to about 3400 Hz) at a sampling rate of about 8 kHz. In addition, an AMR-WB compression mode may sample an audio signal having a frequency of 8 kHz or lower (e.g., about 80 Hz to about 7,000 Hz) at a sampling rate of about 16 kHz. That is, an AMR-WB compressed audio signal may have about twice the frequency bandwidth of an AMR-NB audio signal. Thus, the sensing unit 130 may check the codec, sampling rate and frequency bandwidth of an audio signal to determine whether the audio signal changes.

As another example, there may be some cases where an audio signal is changes to a low-quality audio signal due to network traffic, thereby receiving a changed signal while a streaming service is used. The web server may change from a high-quality audio signal to a narrowband or low sampling rate audio signal to transmit the narrowband or low sampling rate audio signal when the high-quality audio signal is not normally transmitted by network traffic. Thus, the sensing unit 130 may check the sampling rate and frequency bandwidth of an audio signal to determine whether the audio signal changes.

Also, the sensing unit 130 may calculate the difference in the bandwidth of the audio signal when the bandwidth of the audio signal is changed. For example, a received audio signal may be changed from an AMR-WB compressed audio signal from an AMR-NB compressed audio signal. Since a frequency of the AMR-WB audio signal is about 80 Hz to about 7000 Hz and a frequency of the AMR-NB audio signal is about 200 Hz to about 3700 Hz, the sensing unit 130 may perceive that the maximum frequency of the audio signal increases by about 3300 Hz.

The sensing unit 130 may transmit information including the presence and absence of a change in an audio signal and the difference of a bandwidth to the control unit 160 when a received audio signal changes.

Also, the sensing unit 130 may check the battery level and of the electronic device 100 and a network traffic state to transmit related information to the control unit 160.

The bandwidth change unit 140 may gradually (or incrementally) change the bandwidth a received audio signal from the bandwidth of an audio signal before a change to the bandwidth of an audio signal after a change for a preset time, when the received audio signal is changed. That is, even if an audio signal is changes at a first point in time, the bandwidth change unit 140 may prevent a sudden change in sound quality by gradually changing the bandwidth of the received audio signal for a preset time. The bandwidth change unit 140 is described in detail with reference to FIG. 2.

Figure 2:
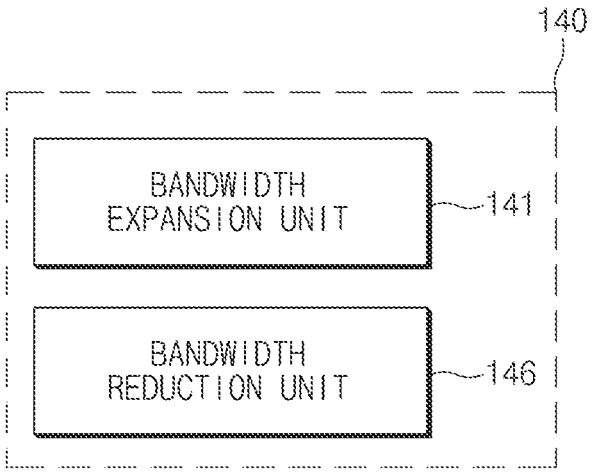
FIG. 2 is a block diagram of a bandwidth change unit according to an embodiment of the present disclosure.

FIG. 2 is a block diagram of a bandwidth change unit according to an embodiment of the present disclosure.

Referring to FIG. 2, the bandwidth change unit 140 includes a bandwidth expansion unit 141 and a bandwidth reduction unit 146. When a received audio signal changes from a wideband signal to a narrowband signal, the bandwidth expansion unit 141 may operate, and when the wideband signal changes to the narrowband signal, the bandwidth reduction unit 146 may operate.

When the received audio signal changes from the wideband signal to the narrowband signal, the bandwidth expansion unit 141 may expand the bandwidth of a narrowband signal to the bandwidth of a wideband signal and then gradually recover the bandwidth of the narrowband signal for a preset time. The bandwidth expansion unit 141 is described in detail with reference to FIGS. 3 and 4.

Figure 3:
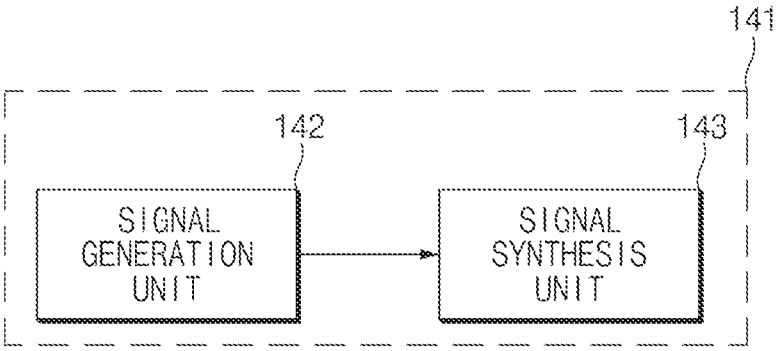
FIG. 3 is a block diagram of a bandwidth expansion unit according to an embodiment of the present disclosure.

FIG. 3 is a block diagram of a bandwidth expansion unit according to an embodiment of the present disclosure.

Referring to FIG. 3, the bandwidth expansion unit 141 includes a signal generation unit 142 and a signal synthesis unit 143.

The signal generation unit 142 may generate a high-band signal by using the narrowband signal when the received audio signal changes from the wideband signal to the narrowband signal. For example, the AMR-NB compressed audio signal may have a frequency of about 200 Hz to about 3700 Hz. The signal generation unit 142 may generate a high-band signal of about 3700 Hz to about 7000 Hz that the AMR-WB compressed audio signal has, by using the AMR-NB compressed audio signal.

In this example, the signal generation unit 142 may gradually reduce the maximum frequency of a generated high-band signal to the maximum frequency of the narrowband signal. For example, when the received audio signal changes from the wideband signal to the narrowband signal, the signal generation unit 142 may first generate a high-band signal and then gradually or gradually reduce the maximum frequency to the maximum frequency of the narrowband signal for a preset time. That is, when the preset time elapses, the signal generation unit 142 does not generate a high-band signal.

The signal synthesis unit 143 synthesizes the narrowband signal and the high-band signal generated by the signal generation unit 142 into a single signal. Thus, the bandwidth expansion unit 141 may expand the bandwidth of a received narrowband signal to the bandwidth of the wideband signal and gradually recover the narrowband signal for a preset time.

Figure 4:
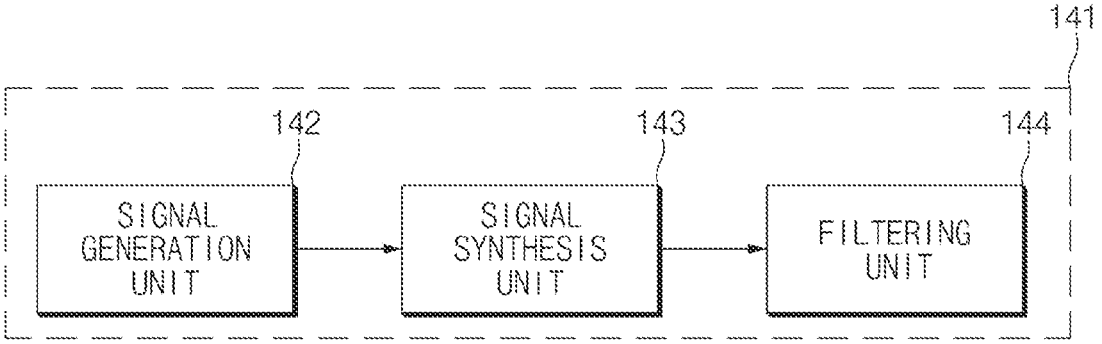
FIG. 4 is a block diagram of a bandwidth expansion unit according to another embodiment of the present disclosure.

FIG. 4 is a block diagram of a bandwidth expansion unit according to another embodiment of the present disclosure.

Referring to FIG. 4, the bandwidth expansion unit 141 includes the signal generation unit 142, the signal synthesis unit 143, and a filtering unit 144.

The signal generation unit 142 may generate a high-band signal corresponding to a changed bandwidth by using a narrowband signal when a received audio signal is changed from a wideband signal to the narrowband signal. For example, an AMR-NB compressed audio signal may have a frequency of about 200 Hz to about 3700 Hz. The signal generation unit 142 may generate a high-band signal corresponding to an AMR-WB compressed audio signal by using the AMR-NB compressed audio signal.

The signal synthesis unit 143 synthesizes the narrowband signal and the high-band signal generated by the signal generation unit 142 into a single signal.

The filtering unit 144 filters the synthesized signal. The filtering unit 144 may filter at least a portion of the high-band signal generated by the signal generation unit 142. For example, when the signal generation unit 142 generates a high-band signal of about 3700 Hz to about 7000 Hz, the filtering unit 144 may filter at least a portion of the high-band signal, gradually reducing the signal from the maximum frequency of the high-band signal (about 7000 Hz) to the minimum frequency (about 3700 Hz) for a preset time. When the preset time elapses, the filtering unit 144 may output only a narrowband signal because the high-band signals are filtered.

In particular, the filtering unit 144 may be implemented in a low pass filter. When the filtering unit 144 is implemented in the low pass filter, the low pass filter may filter a synthesized signal, decreasing a cut-off frequency from the maximum frequency of a wideband signal to the maximum frequency of a narrowband signal for a preset time.

When the preset time elapses, the operation of the bandwidth expansion unit 141 ends and a received narrowband signal may be output.

The bandwidth expansion unit 141 may differently operate according to a setting state. When a received audio signal is changed from a wideband signal to a narrowband signal, a user may configure whether to expand the bandwidth of the narrowband signal and then gradually recover an original bandwidth or whether to continue to expand the bandwidth of the narrowband signal.

When it is set to expand the bandwidth and then recover the original bandwidth, operations may be performed as described with reference to FIGS. 3 and 4.

When it is set to continue to expand the narrow band to the wideband signal, it is possible to continue to expand the bandwidth of the narrowband signal to the bandwidth of the wideband signal to provide a high-quality audio signal to a user.

The bandwidth expansion unit 141 may differently operate according to a battery level or network state even if it is set to continue to expand the narrowband signal to the wideband signal. For example, when the battery level of the electronic device 100 is sufficient and network traffic receiving an audio signal is normal, it is possible to continue to expand the bandwidth of the narrowband signal to provide a high-quality audio signal to a user.

However, when the battery level is below a preset level, there is a need to decrease power consumption. In this case, the bandwidth expansion unit 141 may not operate when an original narrowband signal is output after a preset time, as described with reference to FIGS. 3 and 4. Also, when network traffic receiving an audio signal is high and the narrowband signal is received, the sound quality may decrease even if the high-band signal is set be generated. When network traffic is equal to or larger than a preset value, the bandwidth expansion unit 141 may not operate when an original narrowband signal is output after a preset time, as described with reference to FIGS. 3 and 4.

Referring back to FIG. 2, when the received audio signal is changed from the narrowband signal to the wideband signal, the bandwidth reduction unit 146 may reduce the bandwidth of the wideband signal to the bandwidth of the narrowband signal and then gradually recover the bandwidth of the wideband signal for a preset time.

The bandwidth reduction unit 146 may include a filtering unit (not shown) for filtering a received wideband signal. In particular, the filtering unit (not shown) may be implemented via a low pass filter. When the filtering unit (not shown) is implemented via the low pass filter, the low pass filter may filter the wideband signal, increasing a cut-off frequency from the maximum frequency of the narrowband signal to the maximum frequency of the wideband signal for a preset time.

Referring back to FIG. 1, the audio output unit 150 may output an audio signal output from the bandwidth change unit 140. The audio output unit 150 may be implemented in an audio output device such as an amplifier or a speaker, or in an output port that transmits an audio signal to an external amplifier or to an earphone.

The bandwidth of an audio signal output from the audio output unit 150 is described with reference to FIGS. 5 and 6.

Figure 5:
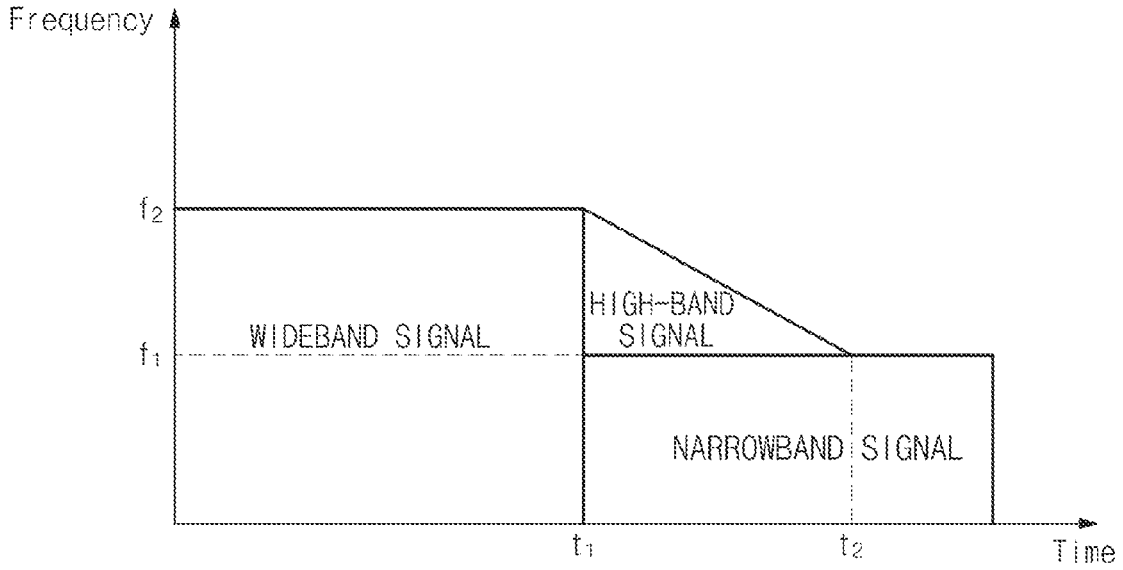
FIG. 5 represents the bandwidth of an audio signal output from an audio output unit according to an embodiment of the present disclosure.

FIG. 5 represents the bandwidth of an audio signal output from an audio output unit according to an embodiment of the present disclosure.

Referring to FIG. 5, an example of a received audio signal changing from a wideband signal to a narrowband signal is illustrated. Specifically, in FIG. 5, an x-axis represents time and a y-axis represents the frequency of an audio signal output over time. When an audio signal received while a wideband signal, having the maximum frequency $f_2$, is changed to a narrowband signal having the maximum frequency $f_1$ at time $t_1$, a signal obtained by synthesizing the narrowband signal and a high-band signal may be output. The high-band signal may have a frequency band of the maximum frequency $f_1$ of an initial narrowband signal to the maximum frequency $f_2$ of a wideband signal. In addition, the maximum frequency of the high-band signal continues to decrease from $f_2$ to $f_1$ for a preset time $t_2$-$t_1$ to enable only a narrowband signal to be output since time $t_2$.

Figure 6:
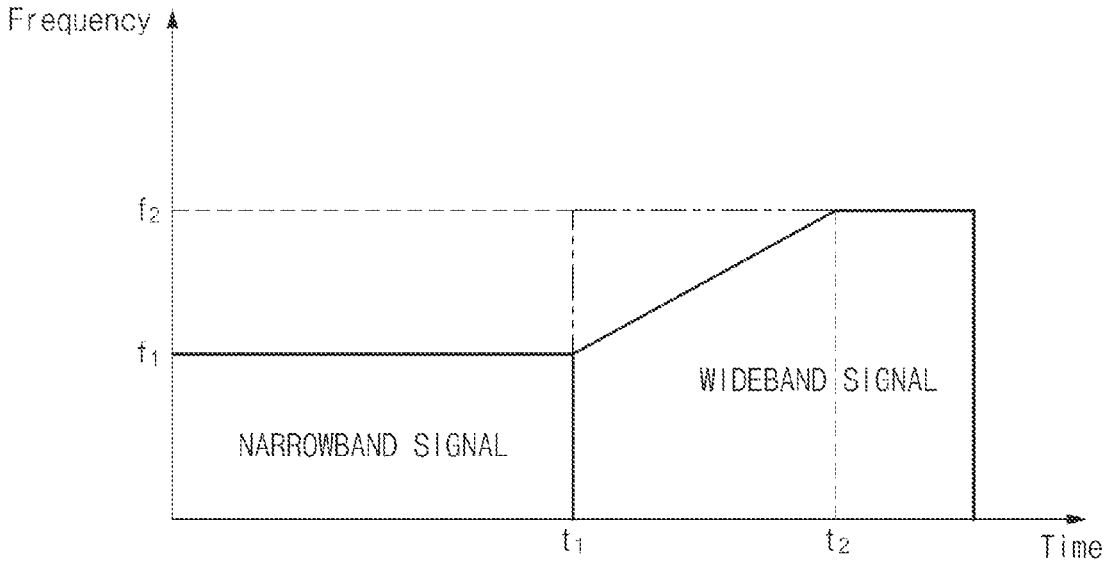
FIG. 6 represents the bandwidth of an audio signal output from an audio output unit according to another embodiment of the present disclosure.

FIG. 6 represents the bandwidth of an audio signal output from an audio output unit according to another embodiment of the present disclosure.

Referring to FIG. 6, an example of a received audio signal changing from a narrowband signal to a wideband signal is illustrated. Specifically, in FIG. 6, an x-axis represents a time and a y-axis represents the frequency of an audio signal output over time. When an audio signal received while a narrowband signal having the maximum frequency $f_1$ is output is changed to a wideband signal having the maximum frequency $f_2$ at time $t_1$, the frequency band of $f_1$ to $f_2$ of the wideband signal may be filtered and outputted. In addition, the maximum frequency of the wideband signal continues to increase from $f_1$ to $f_2$ for a preset time $t_2$-$t_1$ to enable an original wideband signal to be output since time $t_2$.

Referring to FIGS. 5 and 6, the bandwidth of an output audio signal may gradually vary even if a received audio signal is changed from the wideband signal to the narrowband signal or from the narrowband signal to the wideband signal. Thus, it is possible to prevent a sudden change in sound quality of an audio signal.

In addition, the audio output unit 150 may output a signal providing a notification that the sound quality of the audio signal changes. In particular, it is possible to output different signals in order to distinguish when the bandwidth of the received audio signal is expanded or reduced. Also, the audio output unit 150 may output different signals indicating why sound quality changed (for example, an increase in battery level or in network traffic). Thus, a user may intuitively perceive the presence and absence of a change in sound quality of an audio signal and the reason why sound quality changed.

Referring back to FIG. 1, the control unit 160 may control the overall operations of the electronic device 100. In particular, the control unit 160 may control the reception unit 110, the signal processing unit 120, the sensing unit 130, the bandwidth change unit 140, the audio output unit 150, and the display unit 170 respectively to change the bandwidth of the received audio signal according to various embodiments of the present disclosure.

In particular, the control unit 160 may operate the bandwidth change unit 140 when a signal including the presence and absence of a change in an audio signal and the difference of bandwidth is received from the sensing unit 130. When the bandwidth change unit 140 does not operate, the audio signal received by the reception unit 110 may be output through the audio output unit 150 via the signal processing unit 120. When the change in the audio signal is sensed by the sensing unit 130, the control unit 160 may operate the bandwidth change unit 140 to change the bandwidth of an output audio signal.

When the change in the audio signal is sensed by the sensing unit 130, the control unit 160 may selectively operate the bandwidth expansion unit 141 or the bandwidth reduction unit 146. In particular, when an audio signal changes from a wideband signal to a narrowband signal, the control unit 160 may operate the bandwidth expansion unit 141, and when the narrowband signal changes to the wideband signal, the control unit may operate the bandwidth reduction unit 146. In addition, when a preset time elapses and a signal having the same bandwidth as an initially input audio signal is output, it is possible to end the operation of the bandwidth change unit 140.

The display unit 170 may display an object providing a notification that the sound quality of the audio signal changed. The object may be displayed in the form of a character or icon. The object may include information such as an increase or decrease in the sound quality of the received audio signal or a reason why the sound quality has been changed (for example, an increase in a battery level or network traffic). Thus, a user may intuitively perceive the change in sound quality of an audio signal and the reason why the sound quality has been changed.

Figure 7:
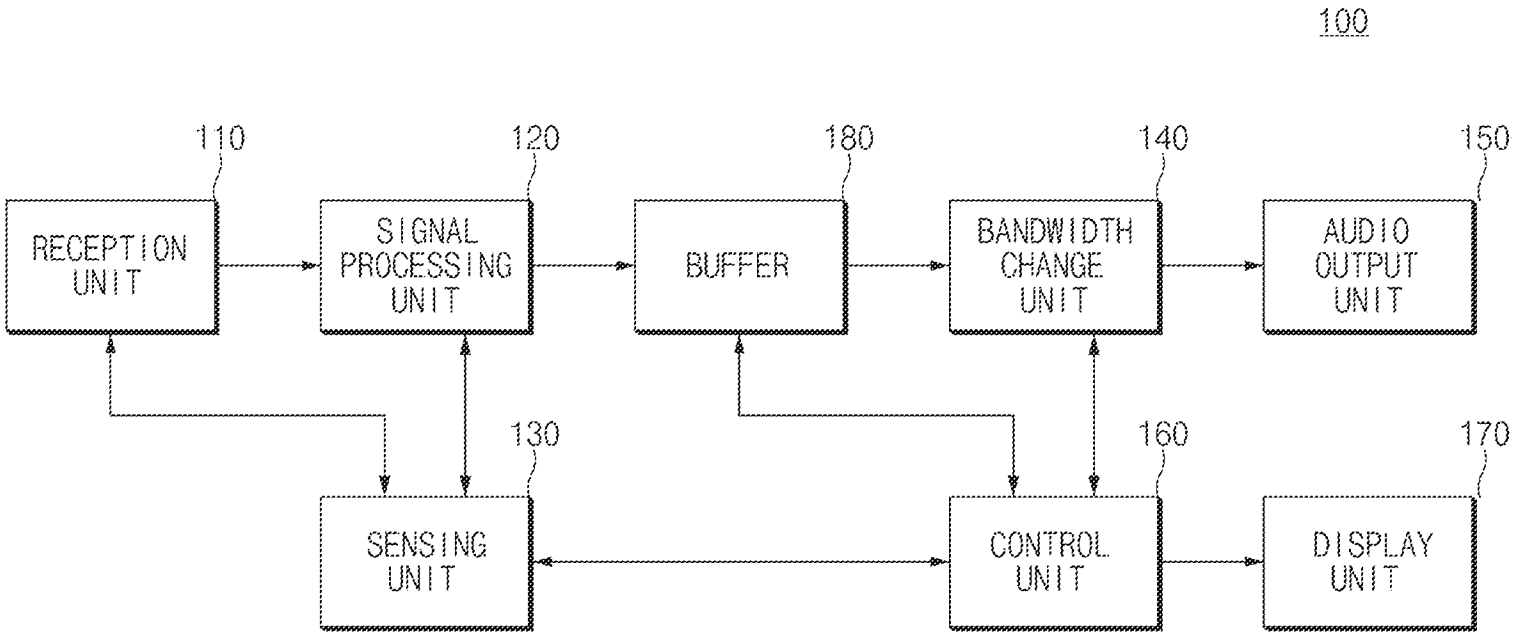
FIG. 7 is a block diagram of an electronic device according to another embodiment of the present disclosure.

FIG. 7 is a block diagram of an electronic device according to another embodiment of the present disclosure.

Referring to FIG. 7, the electronic device 100 may further include a buffer 180 in addition to the reception unit 110, the signal processing unit 120, the sensing unit 130, the bandwidth change unit 140, the audio output unit 150, the control unit 160, and the display unit 170. Since the operations of other components excluding the buffer 180 among components shown in FIG. 7 are similar to those described with reference to FIG. 1, differences are mostly described.

The buffer 180 may receive a signal output from the signal processing unit 120, store a received signal for a preset time, and then output a stored signal to the bandwidth change unit 140. That is, the bandwidth change unit 140 may receive an audio signal after a preset time.

The bandwidth change unit 140 may gradually change the bandwidth of the buffered audio signal input from the bandwidth of an audio signal before the change to the bandwidth of an audio signal after the change for a preset time. In this example, the preset time may be set to be the same as a time for which the audio signal is stored in the buffer 180.

The bandwidth change unit 140 may include the bandwidth expansion unit 141 and the bandwidth reduction unit 146. When a received audio signal is changed from a narrowband signal to a wideband signal, the bandwidth expansion unit 141 may operate, and when the wideband signal is changed to the narrowband signal, the bandwidth reduction unit 146 may operate.

The bandwidth expansion unit 141 may gradually change the bandwidth of the narrowband signal input from the buffer 180 to the bandwidth of the wideband signal for the preset time when the received audio signal is changed from the narrowband signal to the wideband signal.

According to an embodiment of the present disclosure, the bandwidth expansion unit 141 may include the signal generation unit 142 and the signal synthesis unit 143.

The signal generation unit 142 may generate a high-band signal by using the narrowband signal input from the buffer 180 when the received audio signal is changed from the narrowband signal to the wideband signal. In this example, the signal generation unit 142 may gradually increase the maximum frequency of a generated high-band signal from the maximum frequency of the narrowband signal to the maximum frequency of the wideband signal.

The signal synthesis unit 143 synthesizes the narrowband signal and the high-band signal generated by the signal generation unit 142. Thus, the bandwidth expansion unit 141 may gradually change the bandwidth of the narrowband signal to the wideband signal for the preset time.

According to an embodiment of the present disclosure, the bandwidth expansion unit 141 may include the signal generation unit 142, the signal synthesis unit 143, and the filtering unit 144.

The signal generation unit 142 may generate a high-band signal corresponding to a changed bandwidth by using the narrowband signal when the received audio signal is changed from the narrowband signal to the wideband signal. For example, an AMR-NB compressed audio signal may have a frequency of about 200 Hz to about 3700 Hz. The signal generation unit 142 may generate a high-band signal of about 3700 Hz to about 7000 Hz that an AMR-WB compressed audio signal has, by using the AMR-NB compressed audio signal.

The signal synthesis unit 143 synthesizes the narrowband signal and the high-band signal generated by the signal generation unit 142.

The filtering unit 144 filters a signal synthesized by the signal synthesis unit 143. The filtering unit 144 may filter at least a portion of the high-band signal generated by the signal generation unit 142. For example, when the signal generation unit 142 generates a high-band signal of about 3700 Hz to about 7000 Hz, the filtering unit 144 may filter at least a portion of the high-band signal, gradually expanding the signal from the minimum frequency of the high-band signal, about 3700 Hz, to the maximum frequency, about 7000 Hz, for the preset time. Since the filtering unit 144 does not filter a signal after the preset time elapses, an audio signal having the same bandwidth as the wideband signal may be output.

In particular, the filtering unit 144 may be implemented in a low pass filter. When the filtering unit 144 is implemented in the low pass filter, the low pass filter may filter a synthesized signal, increasing a cut-off frequency from the maximum frequency of a narrowband signal to the maximum frequency of a wideband signal for a preset time.

When the preset time elapses, the operation of the bandwidth expansion unit 141 ends and a wideband signal input from the buffer 180 may be output.

The bandwidth reduction unit 146 may gradually recover the bandwidth of the narrowband signal from the bandwidth of the wideband signal input from the buffer 180 for the preset time when the received audio signal is changed from the wideband signal to the narrowband signal.

The bandwidth reduction unit 146 may include a filtering unit (not shown) for filtering a wideband signal input from the buffer 180. In particular, the filtering unit (not shown) may be implemented via a low pass filter. When the filtering unit (not shown) is implemented in the low pass filter, the low pass filter may filter the wideband signal input from the buffer 180, decreasing a cut-off frequency from the maximum frequency of the wideband signal to the maximum frequency of the narrowband signal for a preset time.

The audio output unit 150 may output a signal providing a notification that the sound quality of an audio signal has changed. Since a changed audio signal is output after a time preset by the buffer 180, it is possible to output a signal providing a notification that the sound quality of the audio signal has been changed, at the timing when the audio signal is actually output.

Also, the display unit 170 may display an object providing a notification that the sound quality of the audio signal has changed. Since a changed audio signal is output after a time preset by the buffer 180, it is possible to display an object providing a notification that the sound quality of the audio signal has been changed, with the timing when the audio signal is actually output.

Figure 8:
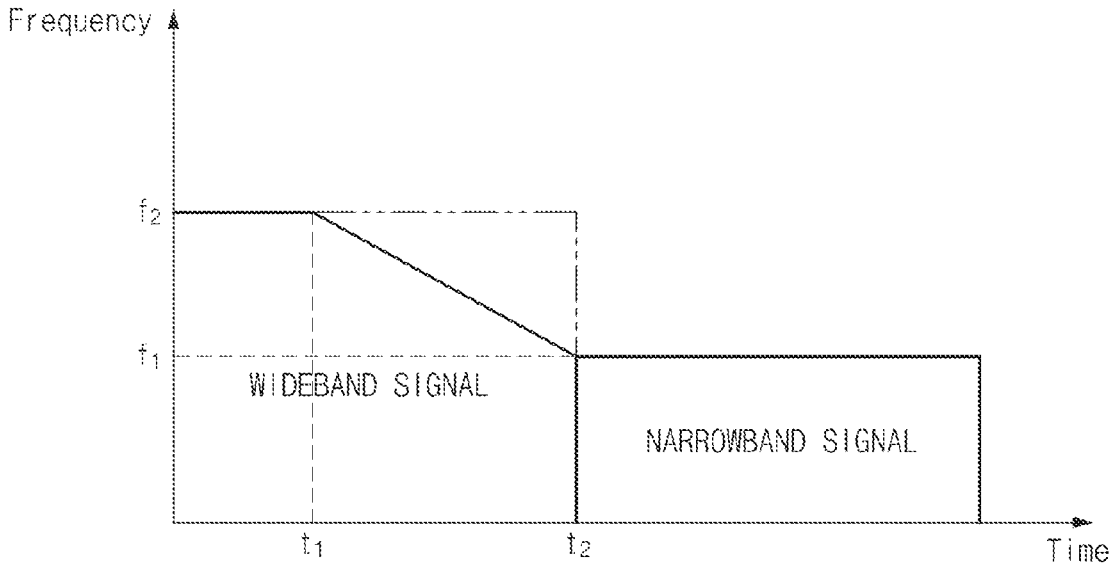
FIG. 8 represents the bandwidth of an audio signal output from an audio output unit according to another embodiment of the present disclosure.

FIG. 8 represents the bandwidth of an audio signal output from an audio output unit according to another embodiment of the present disclosure.

Referring to FIG. 8, the electronic device 100 includes the buffer 180 and an audio signal received by the reception unit 110 is changed from a wideband signal to a narrowband signal. Specifically, an x-axis represents a time and a y-axis represents the frequency of an audio signal output over time. When an audio signal, which is received while a wideband signal having the maximum frequency $f_2$ is output, is changed to a narrowband signal having the maximum frequency $f_1$ at time $t_1$, the maximum frequency of the wideband signal decreases from $f_2$ to $f_1$ for a preset time $t_2-t_1$ and a signal having the same bandwidth as the narrowband signal may be output at time $t_2$. In addition, a narrowband signal stored in the buffer 180 for the preset time may be output after time $t_2$.

Figure 9:
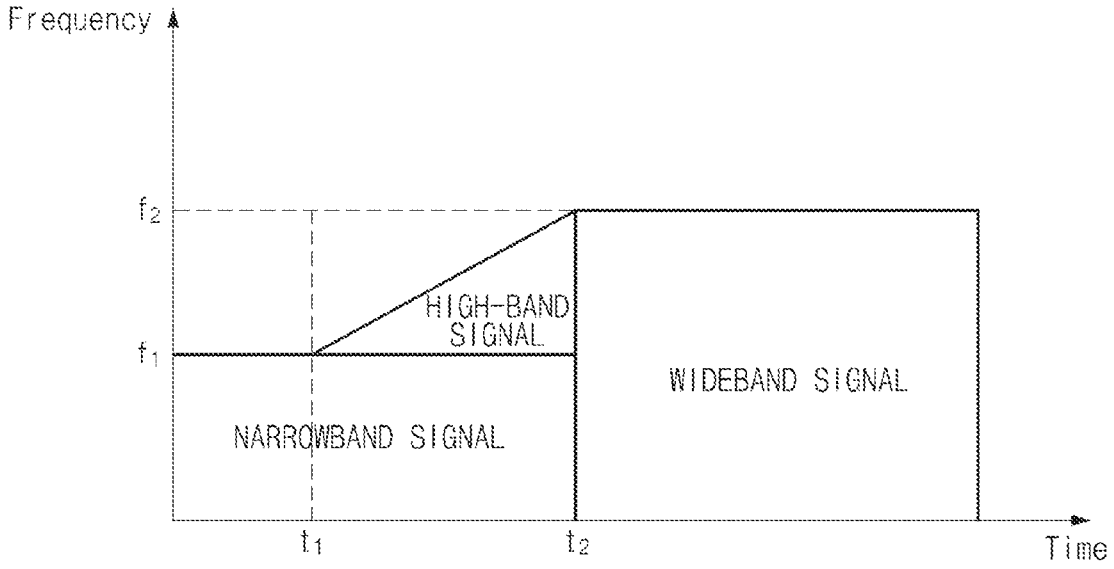
FIG. 9 represents the bandwidth of an audio signal output from an audio output unit according to another embodiment of the present disclosure.

FIG. 9 represents the bandwidth of an audio signal output from an audio output unit according to another embodiment of the present disclosure. In particular, FIG. 9 represents an example of a case where the electronic device 100 includes the buffer 180 and an audio signal received by the reception unit 110 is changed from a narrowband signal to a wideband signal.

Referring to FIG. 9, the electronic device 100 includes the buffer 180 and an audio signal received by the reception unit 110 is changed from a narrowband signal to a wideband signal. Specifically, an x-axis represents a time and a y-axis represents the frequency of an audio signal output over time. When an audio signal received while a narrowband signal having the maximum frequency $f_1$ is output and is changed to a wideband signal having the maximum frequency $f_2$ at time $t_1$, a signal obtained by synthesizing the narrowband signal and a high-band signal may be output. The maximum frequency of the high-band signal continues to increase from $f_1$ to $f_2$ for a preset time $t_2-t_1$ to enable a signal having the same bandwidth as the wideband signal to be output at time $t_2$. In addition, a wideband signal stored in the buffer 180 for the preset time may be output after time $t_2$.

Referring to FIGS. 8 and 9, the bandwidth of an output audio signal may gradually vary even if a received audio signal is changed from the wideband signal to the narrowband signal or vice versa. Thus, it is possible to prevent a sudden change in sound quality of an audio signal.

Figure 10:
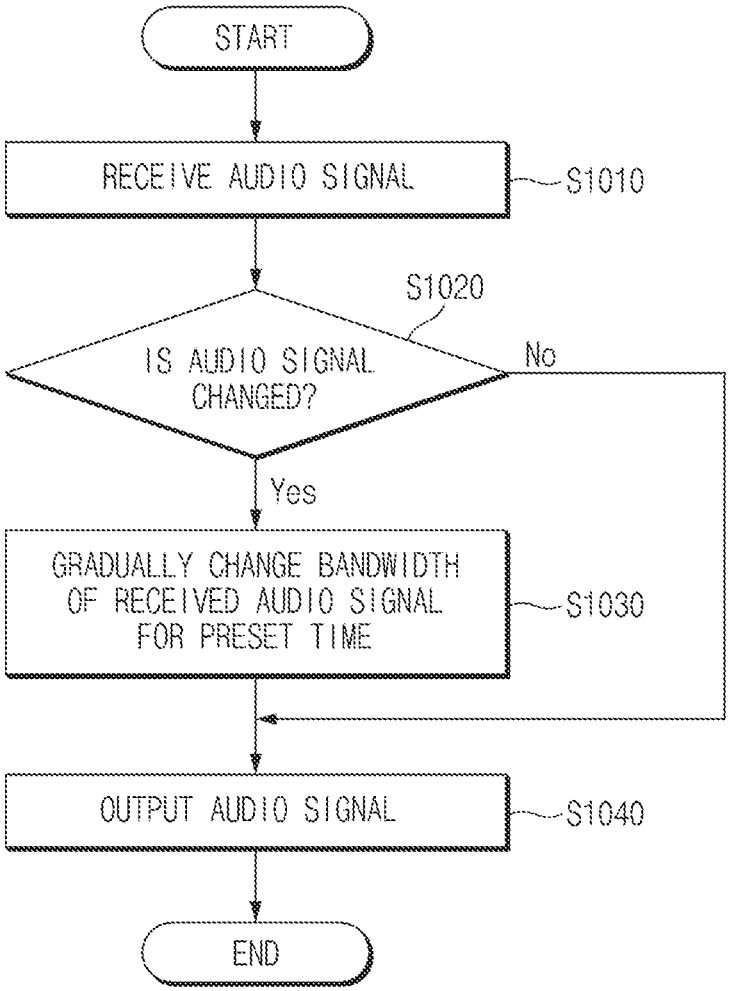
FIG. 10 is a flowchart of a method of controlling an electronic device according to an embodiment of the present disclosure.

FIG. 10 is a flowchart of a method of controlling an electronic device according to an embodiment of the present disclosure.

Referring to FIG. 10, the electronic device 100 receives an audio signal in operation S1010. For example, it is possible to receive an audio signal including the opposite side's voice from a transmission-side electronic device when a user performs a voice call with the electronic device 100. Alternatively, when a user reproduces an audio signal through an audio streaming service by using the electronic device 100, it is possible to receive an audio signal from a web server.

In addition, it is determined whether a received audio signal has been changed in operation S1020. In particular, it is possible to determine whether the bandwidth of the received audio signal has been changed. The electronic device 100 may check the codec type, sampling rate, and bandwidth of the received audio signal to determine whether the received audio signal has been changed. Also, it is possible to calculate the difference of the bandwidth of the audio signal when the bandwidth of the audio signal is changed.

When the received audio signal has not been changed in operation S1020, it is possible to output the audio signal in operation S1040.

When the received audio signal changes in operation S1020, the bandwidth of the received audio signal gradually changes from the bandwidth of an audio signal before a change to the bandwidth of an audio signal after a change for a preset time in operation S1030. Since the process of gradually changing the bandwidth of the audio signal has been described with reference to FIGS. 1 to 9, repetitive descriptions are not provided in detail.

When the received audio signal is changed from a wideband signal to a narrowband signal, it is possible to expand the bandwidth of the narrowband signal to the bandwidth of the wideband signal and then gradually recover the bandwidth of an existing signal for a preset time.

It is possible to expand the narrowband signal to the wideband signal by generating a high-band signal by using the narrowband signal and synthesizing the narrowband signal and a generated high-band signal. According to an embodiment of the present disclosure, it is possible to gradually reduce the maximum frequency of a high-band signal from the maximum frequency of a wideband signal to the maximum frequency of a narrowband signal when generating the high-band signal in order to gradually change the bandwidth of an output audio signal. According to another embodiment of the present disclosure, it is possible to filter a synthesized signal, decreasing the cut-off frequency of a low pass filter from the maximum frequency of a wideband signal to the maximum frequency of a narrowband signal.

When the received audio signal is changed from the narrowband signal to the wideband signal, it is possible to reduce the bandwidth of the wideband signal to the bandwidth of the narrowband signal and then gradually recover the bandwidth of an existing signal for a preset time. In particular, it is possible to filter the wideband signal, increasing the cut-off frequency of a low pass filter from the maximum frequency of the narrowband signal to the maximum frequency of the wideband signal for a preset time.

According to another embodiment of the present disclosure, a received audio signal may be buffered for a preset time and then output. In this case, when the received audio signal changes from a narrowband signal to a wideband signal, it is possible to generate a high-band signal by using a narrowband signal input from the buffer. In addition, it is possible to gradually increase the maximum frequency of a generated high-band signal from the maximum frequency of the narrowband signal to the maximum frequency of the wideband signal. In addition, it is possible to synthesize the narrowband signal and a generated high-band signal.

According to another embodiment of the present disclosure, when a received audio signal is changed from a wideband signal to a narrowband signal, it is possible to generate a high-band signal corresponding to a changed bandwidth by using the narrowband signal input from a buffer. In addition, it is possible to filter a synthesized signal, increasing the cut-off frequency of a low pass filter from the maximum frequency of the narrowband signal to the maximum frequency of the wideband signal for a preset time.

In addition, when the received audio signal is stored in the buffer for a preset time and then output, it is possible to gradually recover the bandwidth of the narrowband signal from the bandwidth of the wideband signal input from the buffer when the received audio signal is changed from the narrowband signal to the wideband signal. In particular, it is possible to filter the wideband signal input from the buffer, decreasing the cut-off frequency of a low pass filter from the maximum frequency of the wideband signal to the maximum frequency of the narrowband signal for a preset time.

Subsequently, an audio signal having a changed bandwidth is output in operation S1040. Since an output audio signal has been described with reference to FIGS. 5, 6, 8 and 9, its detailed description is not provided.

A method of controlling an electronic device according to an embodiment of the present disclosure may output a signal providing a notification that the sound quality of an audio signal has been changed when a received audio signal changes. In addition, it is possible to display, on a display screen, a notification that the sound quality of the audio signal has changed. Thus, a user may intuitively perceive the change in sound quality of an audio signal and the reason why the sound quality changed.

The method of controlling the electronic device according to various embodiments of the present disclosure as described above may be implemented in programs that may be executed on a terminal device. In addition, these programs may be stored and used in various types of non-transitory recording mediums.

In particular, program codes for performing the above-described methods may be stored in various types of non-transitory recording mediums such as a flash memory, a read only memory (ROM), an erasable programmable ROM (EPROM), an electronically erasable and programmable ROM (EEPROM), a hard disk, a removable disk, a memory card, an USB memory, and a CD-ROM.

According to various embodiments of the present disclosure, the bandwidth of an output audio signal may gradually vary even if a received audio signal is changed. Thus, it is possible to prevent a sudden change in sound quality of an audio signal.

Also, a user may intuitively perceive a change in sound quality of an audio signal and the reason why the sound quality changed because a notification is provided to a user.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a receiver configured to receive an audio signal;

at least one processor configured to gradually change a bandwidth of the received audio signal from a first bandwidth to a second bandwidth during a preset time, when the received audio signal is changed; and an audio output interface configured to output the received audio signal, wherein the at least one processor is further configured to:

when the received audio signal is changed from a wideband signal to a narrowband signal, expand the bandwidth of the received audio signal to the first bandwidth and gradually reduce the bandwidth of the received audio signal to the second bandwidth during the preset time, and when the received audio signal is changed from the narrowband signal to the wideband signal, reduce the bandwidth of the received audio signal to the first bandwidth and gradually increase the bandwidth of the received audio signal to the second bandwidth during the preset time, wherein, when the received audio signal is changed from a wideband signal to a narrowband signal, the first bandwidth corresponds to the wideband signal and the second bandwidth corresponds to the narrowband signal, and wherein, when the received audio signal is changed from the narrowband signal to the wideband signal, the first bandwidth corresponds to the narrowband signal and the second bandwidth corresponds to the wideband signal.

2. The electronic device according to claim 1, further comprising a display configured to display an object providing a notification that sound quality of the audio signal is changed, when the received audio signal is changed.

3. The electronic device according to claim 1, wherein the at least one processor is further configured to:

generate a high-band signal by using the received audio signal and gradually reduce a maximum frequency of the high-band signal from a maximum frequency of the wideband signal to a maximum frequency of the narrowband signal, and synthesize the received audio signal and the high-band signal.

4. The electronic device according to claim 1, further comprising:

a low pass filter, wherein the at least one processor is further configured to:

generate a high-band signal by using the received audio signal, and synthesize the received audio signal and the high-band signal, and wherein the low pass filter is configured to filter the synthesized signal by decreasing a cut-off frequency from a maximum frequency of the wideband signal to a maximum frequency of the narrowband signal.

5. The electronic device according to claim 1, further comprising a low pass filter configured to filter the received audio signal by increasing a cut-off frequency from a maximum frequency of the narrowband signal to a maximum frequency of the wideband signal.

6. The electronic device according to claim 1, further comprising a buffer configured to store the received audio signal for the preset time and then output the signal to the at least one processor.

7. The electronic device according to claim 1, wherein the audio output interface is further configured to output a signal providing a notification that sound quality of the audio signal is changed, when the received audio signal is changed.

8. A method of controlling an electronic device, the method comprising:

receiving an audio signal;

gradually changing a bandwidth of the received audio signal from a first bandwidth to a second bandwidth during the preset time, when the received audio signal is changed; and outputting the received audio signal, wherein the gradually changing of the bandwidth of the received audio signal comprises, when the received audio signal is changed from a wideband signal to the narrowband signal, expanding the bandwidth of the received audio signal to the first bandwidth and gradually reducing the bandwidth of the received audio signal to the second bandwidth during the preset time.

9. The method according to claim 8, wherein the expanding of the bandwidth comprises:

generating a high-band signal by using the received audio signal; and synthesizing the received audio signal and the high-band signal.

10. The method according to claim 9, wherein the gradually reducing of the bandwidth of the received audio signal to the second bandwidth comprises gradually reducing a maximum frequency of the synthesized signal from a maximum frequency of the wideband signal to a maximum frequency of the narrowband signal.

11. The method according to claim 9, wherein the gradually reducing of the bandwidth of the received audio signal to the second bandwidth comprises filtering the synthesized signal by decreasing a cut-off frequency of a low pass filter from a maximum frequency of the wideband signal to a maximum frequency of the narrowband signal.

12. The method according to claim 8, wherein the gradually changing of the bandwidth of the received audio signal comprises:

when the received audio signal is changed from the narrowband signal to the wideband signal, reducing the bandwidth of the received audio signal to the first bandwidth and gradually increasing the bandwidth of the received audio signal to the second bandwidth during the preset time.

13. The method according to claim 12, wherein the gradually increasing of the bandwidth of the received audio signal to the second bandwidth comprises filtering the received audio signal by increasing a cut-off frequency of a low pass filter from a maximum frequency of the narrowband signal to a maximum frequency of the wideband signal.

14. The method according to claim 8, further comprising outputting a signal providing a notification that sound quality of the audio signal is changed, when the received audio signal is changed.

15. The method according to claim 8, further comprising displaying an object providing a notification that sound quality of the audio signal is changed, when the received audio signal is changed.

* * * * *